United States Patent [19]

Hekal

[11] 4,407,429

[45] Oct. 4, 1983

[54] CAP FOR AND IN COMBINATION WITH A CONTAINER

[75] Inventor: Ihab M. Hekal, Stamford, Conn.

[73] Assignee: The Continental Group, Inc., Stamford, Conn.

[21] Appl. No.: 370,648

[22] Filed: Apr. 21, 1982

[51] Int. Cl.[3] ..... B65D 41/00

[52] U.S. Cl. ..... 220/359; 220/356

[58] Field of Search ..... 220/359, 352, 356, 358

[56] References Cited

U.S. PATENT DOCUMENTS 1,790,957 2/1931 Sykes ..... 220/358

3,452,921 7/1969 Donovan ..... 220/359

*Primary Examiner*—George T. Hall

*Attorney, Agent, or Firm*—Charles E. Brown

[57] ABSTRACT

This relates to a cap for use in combination with a container body formed of plastics material. The cap has a domed central panel so as to withstand high internal pressures and has a cylindrical mounting portion which is telescoped within the container body and a further cylindrical securing portion which is secured to the upper terminal portion of the container body by means of a removable tape.

10 Claims, 3 Drawing Figures

CAP FOR AND IN COMBINATION WITH A CONTAINER

This invention relates in general to new and useful improvements in containers, and more particularly to containers wherein the bodies of the containers are formed of plastics material and the container is closed by means of a removable cap.

More particularly, this invention relates to a removable cap for a tubular container body wherein the cap is constructed to telescope within the mouth of the container body with a portion of the cap projecting axially above and concentric with the adjacent portion of the container body, and the cap being retained in place against high internal pressures by means of a tape which extends around the container and the cap and is bonded to both.

In accordance with the invention, the cap is formed of a plastics material and includes a domed central panel with the domed central panel withstanding internal pressures from within the container.

Another feature of the invention is the formation of the cap to have a lower cylindrical mounting portion which surrounds a domed central panel and a cylindrical terminal securing portion which is of a larger diameter than the mounting portion and which is joined to the mounting portion by an intermediate offset portion. The mounting portion is of a size to tightly telescope within the open mouth of a container while the securing portion is of a size wherein the exterior surfaces of the container at its mouth and the securing portion are substantially of the same diameter and wherein a simple tape may be bonded to the exterior surfaces of both the securing portion of the cap and the mouth portion of the container so as to retain the cap in place within the container against high internal pressures.

In accordance with this invention, the tape is readily removable and the cap is provided with a lift tab which facilitates its being withdrawn from the mouth of the container so as to open the container for access to the contents thereof.

With the above and other objects in view that will hereinafter appear, the nature of the invention will be more clearly understood by reference to the following detailed description, the appended claims, and the several views illustrated in the accompanying drawings.

Figure 1:
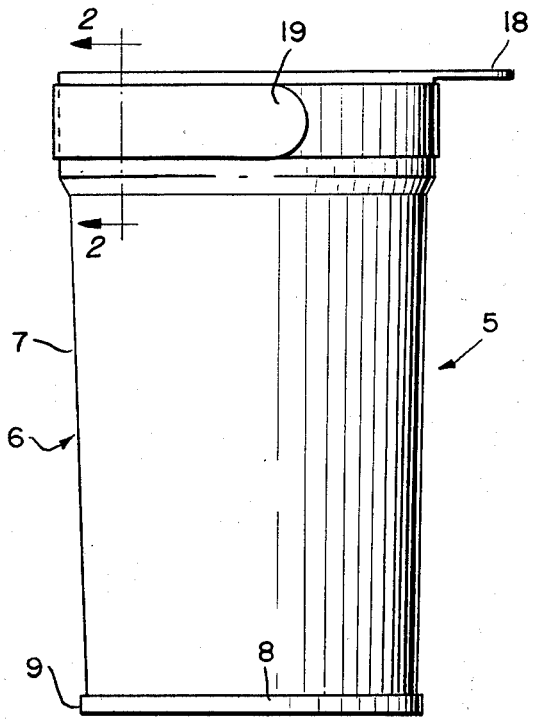
FIG. 1 is an elevational view of a container formed in accordance with this invention and with the upper end of the container closed by a cap also formed in accordance with this invention.

Referring now to the drawings in detail, it will be seen that there is illustrated a container formed in accordance with this invention, the container being generally identified by the numeral 5. The container 5 includes a tubular body 5 which is preferably formed of a plastic material such as PET of other material which is approved for use in the packaging of food products.

The body 5 includes a slightly tapered major portion 7 which is closed at its lower end by means of a standard metal end unit 8 which is secured to the container body 6 by means of a conventional double seam 9.

Adjacent the upper end thereof, the body 6 is outwardly flared as at 10 and then includes a cylindrical portion 11 which defines a dispensing mouth.

The upper end of the container body 6 is closed by means of a cap which is the principal feature of the invention and which is generally identified by the numeral 12. The cap 12 includes a cylindrical mounting portion 13 which surrounds a domed panel 14, the panel 14 being connected to the cylindrical mounting portion 13 by a radius 15.

The cap 12 also includes an upper terminal cylindrical securing portion 16 which is integrally connected to the mounting portion 13 by an intermediate offset portion 17.

It is to be noted that the domed panel 14 extends axially upwardly beyond the extent of the mounting portion 13. It is to be understood that the dome of the domed panel 14 is sufficient to resist internal pressures such as those which may occur in the packaging of carbonated beverages, beer and the like.

It is also to be noted that the securing portion 16 is provided with a lift tab 18 which may be engaged with one's fingers to effect the removal of the cap 12 from the container body 6.

Figure 2:
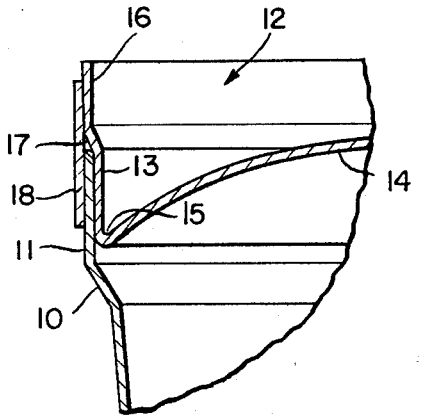
FIG. 2 is an enlarged fragmentary vertical sectional view taken generally along the line 2—2 of FIG. 1 and shows the specific cross section of the upper portion of the container and of the cap, as well as the relationship of the cap and container.
Figure 3:
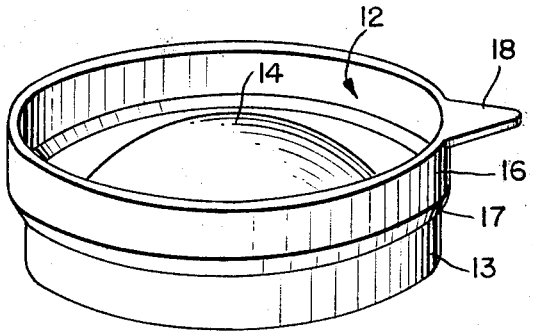
FIG. 3 is a top perspective view of the cap per se.

As is clearly shown in FIG. 2, the external diameter of the mounting portion 13 of the cap corresponds to the internal diameter of the terminal portion 11 of the container body. The cap 12 thus snuggly telescopes within the mouth of the container body 6.

It is also to be noted that the external diameter of the securing portion 16 corresponds to the external diameter of the terminal portion 11 of the container body. Further these exterior surfaces are coaxial and thus aligned.

The cap 12 is pressed into the mouth of the container body 6 until the free edge of the terminal portion 11 abuts the intermediate offset portion 17 of the cap and this axially positions the cap 12 relative to the container body 6. The cap 12, thus positioned within the container body mouth, is secured against axial displacement relative to the container body by wrapping a tape 18 about the exterior surfaces of the securing portion 16 and the terminal portion 11. It is to be noted that the tape 18 is of a width to bridge and properly bond to the securing portion 16 and the terminal portion 11.

It is also to be understood that the tape 18 may either be adhesively bonded or heat bonded to the cap 12 and the container body in sealed relation.

In order to facilitate the removal of the tape, there is provided a free pull tab terminal end 19, as is best shown in FIG. 1. When it is desired to open the container 5, the pull tab 19 is grasped and pulled away from the container, stripping the tape 18 from the container and the cap. The cap is now free to be removed from the container body for the dispensing of the product contained within the container.

In view of the simple construction of the container body and cap and the ability to form them of relatively inexpensive plastics materials, it will be seen that the cost of the container 5 is much less than that of present day cans and also blow molded bottles. Further, the sealing is assured by the simple application of the tape 18.

Although only a preferred embodiment of the cap and corresponding container body has been specifically illustrated and described herein, it is to be understood that minor variations may be made in the cap configuration and structure and in the container without departing from the spirit and scope of the invention as defined by the appended claims.

I claim:

1. A cap for a preselected container having a mouth defined by a cylindrical terminal container portion of a preselected wall thickness, said cap comprising a cylindrical mounting wall, an axially outwardly domed panel within said mounting wall and secured to said mounting wall by a radius, a cylindrical securing wall forming an axial extension of said mounting wall, said securing wall being of a greater diameter than said mounting wall by twice said preselected wall thickness and being joined to said mounting wall by a radially offset intermediate wall.

2. A cap according to claim 1 together with a lift tab extending radially outwardly from an upper edge of said securing wall.

3. A cap according to claim 1 wherein said domed panel extends axially beyond said mounting wall.

4. A cap according to claim 1 wherein said cap is formed of a plastics material.

5. A cap according to claim 1 wherein said cap closes said preselected container with said mounting wall being seated in said container cylindrical mouth.

6. A cap and container combination according to claim 5 wherein exterior surfaces of said securing wall and said terminal container portion are in axial adjacent and aligned relation.

7. A cap and container combination according to claim 6 wherein said terminal container portion has a free edge abutting said cap radially offset intermediate wall to position said cap axially relative to said container.

8. A cap and container combination according to claim 6 wherein a tape extends around and is sealed and bonded to the said exterior surfaces.

9. A cap and container combination according to claim 6 wherein a tape extends around and is sealed and bonded to the said exterior surfaces, said tape having a free starting tab to facilitate removal.

10. A cap and container combination according to claim 5 wherein both said cap and said container are formed of a plastic material.

* * * * *